United States Patent [19]

Braswell

[11] 4,338,914

[45] Jul. 13, 1982

[54] COMBINATION AIR TUNNEL-ANDIRON DEVICE AND FIREPLACE CONSTRUCTION THEREFOR

[76] Inventor: Robert L. Braswell, P.O. Box 392, Alton, Mo. 65606

[21] Appl. No.: 249,989

[22] Filed: Apr. 1, 1981

[51] Int. Cl.[3] ..... F24B 13/02

[52] U.S. Cl. ..... 126/143; 126/164

[58] Field of Search ..... 126/164, 165, 143, 123, 126/120, 242-245; D7/206, 207; D23/127

[56] References Cited

U.S. PATENT DOCUMENTS

| | | | |
|---|---|---|---|
| 2,375,318 | 5/1945 | Mudgett | 126/143 |
| 4,076,012 | 2/1978 | Meeker | 126/143 |
| 4,106,475 | 8/1978 | Mayes | 126/143 |
| 4,173,967 | 11/1979 | Brown | 126/165 |
| 4,213,445 | 7/1980 | Mayo | 126/143 |
| 4,248,205 | 2/1981 | Saunders | 126/143 |

FOREIGN PATENT DOCUMENTS

| | | | |
|---|---|---|---|
| 157643 | 1/1921 | United Kingdom | 126/143 |
| 2036954 | 7/1980 | United Kingdom | 126/143 |

*Primary Examiner*—James C. Yeung
*Attorney, Agent, or Firm*—Jerome A. Gross

[57] ABSTRACT

A combination air tunnel and andiron device conducts air from a fireplace floor opening, forward through an adjustable damper opening and then over and under logs supported spacedly above the upper surface of the air tunnel. The principal structural members are a pair of I-beams extending forwardly from a rear tunnel plate, of a depth roughly twice as great as the height of the air tunnel; their upper chords serve as heavy duty andiron surfaces on which firewood rests, confined forwardly and rearwardly by the upstanding extensions of the forward and rear plates of the tunnel. The space between the air tunnel and the andiron surfaces provides a reservoir for hot coals, to kindle newly added logs. A draft provision is made in the forward plate in registration with the air tunnel.

The combination air tunnel and andiron device is specially useful to provide external draft to fireplaces sealed by glass doors, where a conventional ash grate near the rear of the fireplace may be removed and external air supplied from beneath. For new construction, after a foundation slab is laid, a fire-resistant channel is positioned on it, leading inward through the outer wall of the building. The channel is inverted so that its planar outer web surface is presented upwardly; fire-resistant brick are laid flanking the sides of the channel to form the fireplace floor, but leaving a gap or space at the forward end of the channel, and the outer end is screened. Thereafter, when the fireplace is built about the firebrick floor, the gap or space forwardly of the inner end of the channel permits outside air to flow through the channel and upward into the rear portion of the fireplace, beneath the air tunnel-andiron device so provided.

3 Claims, 3 Drawing Figures

COMBINATION AIR TUNNEL-ANDIRON DEVICE AND FIREPLACE CONSTRUCTION THEREFOR

This invention relates to a combination air tunnel and andiron device especially adapted to provide external draft for a fireplace having closable glass doors, and is particularly valuable in conserving the energy of burning wood when used with conventional fireplaces having ducts through which air circulates along heat-exchange surfaces.

BACKGROUND OF THE INVENTION

The problem of saving energy by use of an exterior source of combustion air to a sealed fireplace is recognized in U.S. Pat. No. 4,213,445 to Mayo. This patent discloses the principle of supplying air from the exterior below the fireplace floor through an ash clean-out grate, which may be completely removed for adequate draft supply. An inverted metal duct having a closed rear end and leading to a forward end is disclosed. Firewood is supported on the upper horizontal duct wall, and retained by sideward slanting wing-like plates. The amount of air is controlled by sliding, into and out of the front end of the metal air duct so provided, a short duct section which is open at the top behind an air deflector plate.

The construction there illustrated is disclosed to heat the upper duct surface to a red heat, so that steel of refractory quality is required. No provision is made for accommodating ashes, nor for permitting any draft below the wood so supported directly on the tunnel surface. That disclosure suggests that the top surface of the duct plus its sideward wings may be considered as equivalent to a log basket.

SUMMARY OF THE INVENTION

The principal purpose of the present invention is to combine the function of such a forward-extending air duct not with that of a log basket, but rather with the function of andirons. Other purposes are to provide great rigidity and impact resistance, to avoid overheating the horizontal plate, accommodate hot coals and ashes beneath the level of logs, and provide for better draft distribution to the logs. In the present invention the combination of air tunnel and andiron device is fabricated from a pair of deep structural I-beams or the equivalent, with a horizontal tunnel plate welded between their web portions at approximately midheight. This provides both an air tunnel extended down to the lower beam chord portions, and an andiron portion extending upward from the tunnel plate to the upper beam chord portions. The open space above the tunnel plate, up to the level of the top of the upper beam chords, serves as a reservoir for hot coals and ashes, and provides a draft about, beneath and between logs on the andiron-like surfaces of the upper beam chords; while draft beneath the logs also serves to cool the tunnel plate.

Forward and aft vertical plates, extending from the level of the lower I-beam chords to substantially above said upper andiron surfaces, confine logs resting on the andiron surfaces. The upward extension of the front plate so deflects the air as to promote combustion of logs in the center and rear. A draft opening in the lower plate is adjustably based by transverse positioning of a damper plate.

Such an air-tunnel and andiron device is readily installed in existing fireplaces of the type having, near its rear wall, a floor ash grate leading downward to an ash container which may be emptied from the outside. The ash grate is simply removed and the lower opening for emptying ashes is screened.

For new residential construction, a source of draft beneath the new device may be provided by the steps of first laying a foundation slab having a planar upper surface, positioning on it a fire-resistant channel inverted to present its outer web surface upwardly, the channel having an open outer end at the exterior of the building wall and leading inward beyond the building inner wall to an inner end in the area of the fireplace to be constructed; then laying a floor of fire resistant brick on the foundation to the level of the upwardly presented web surface of the channel, the floor being contiguous with the channel side edges but spaced away from the forward end of the inverted channel to provide a space or gap. Thereafter, by screening the outer end of the channel and completing the building walls and fireplace, a draft may be provided through the channel from the exterior of the building into the space or gap adjacent to the open forward end of the channel, and thence upwardly beneath the horizontal plate of the air tunnel-andiron device.

DESCRIPTION OF THE PREFERRED EMBODIMENT

Figure 2:
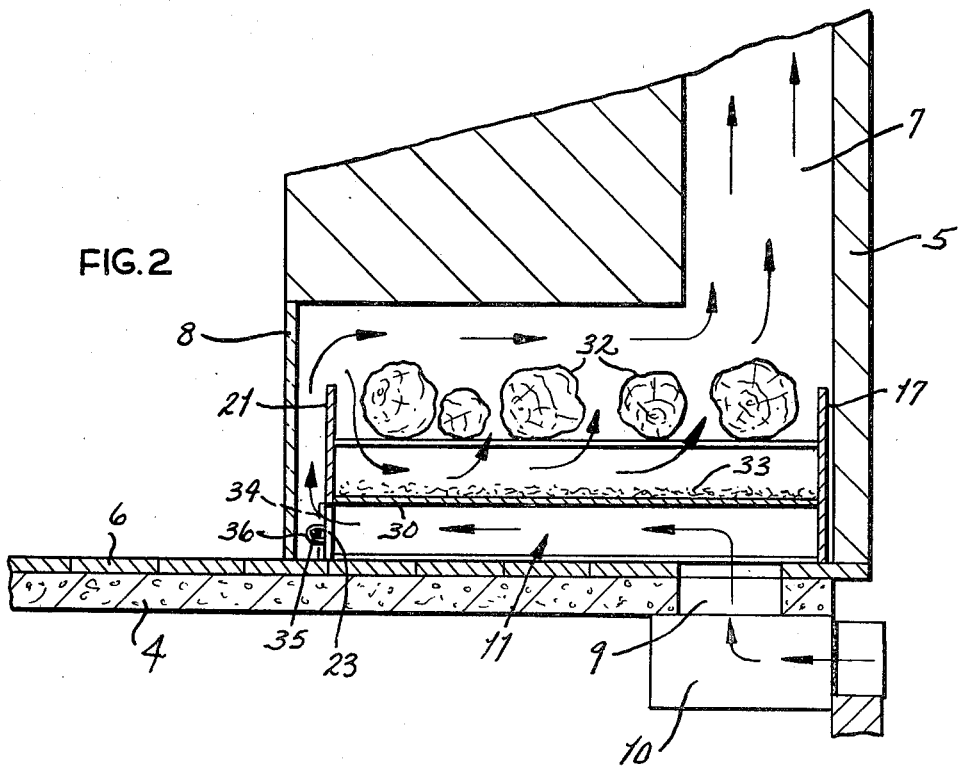
FIG. 2 is a schematic cross-section of the device shown in FIG. 1 as seen along line 2—2 thereof, as installed in a fireplace shown schematically.

Referring first to FIG. 2, a conventional residential building as shown schematically, having a floor slab 4, an exterior wall 5, a thin fire-resistant brick layer 6 on the slab adjacent to the wall within a fireplace area, a fireplace flue 7, a glass fireplace door 8 which may be closed for substantially sealed combustion, and an ash removal opening 9 through the firebrick floor and slab 4 into an ash container 10 having an exterior opening which may be screened as illustrated schematically.

Figure 1:
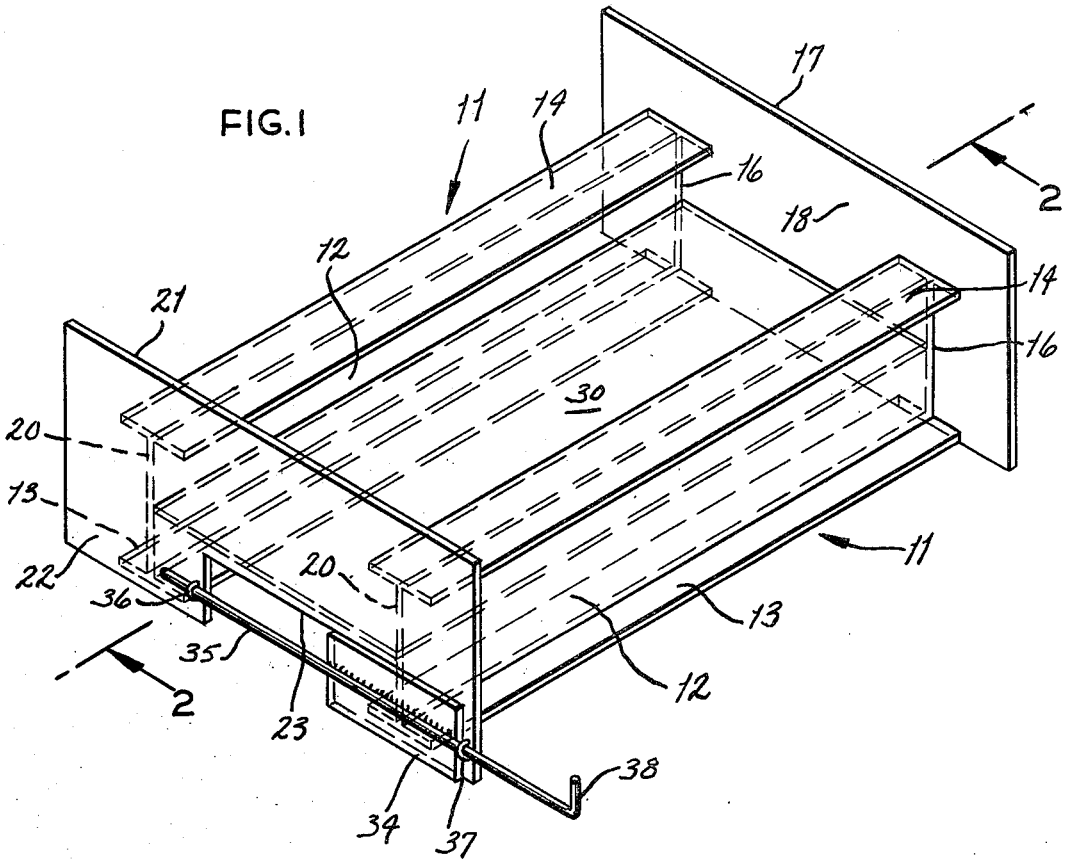
FIG. 1 is a perspective view of a combination air tunnel and and iron device embodying the present invention, shown partly from the front and from above.

The present combination air tunnel and andiron device is preferably fabricated by welding structural iron beams and plate, being sufficiently heat resistant to withstand the temperatures to be encountered which, due to the present construction, are not so severe as those in the prior art device referred to at the beginning of this specification. Referring to FIG. 1 a pair of spaced apart fore-and-aft-extending I-beams generally designated 11 are utilized, with their web portions 12 positioned vertically so that their lower chords 13 may rest on the firebrick 6 and their upper chords 14 be presented upwardly to serve as andiron surfaces. Because of the rigidity of the chords of such I-beams, they can withstand rough handling as may be encountered in handling the andiron device and throwing heavy logs on it.

The beams 11 have vertical rear end edges 16 joined by a rear vertical plate 17 which extends to the bottom of the lower chords 13, all in a common plane so as to seal substantially against a flat floor. The rear plate 17 has an upward extending portion 18 which rises to a level substantially above the upper chords 14; this portion 18 serves to restrain firewood on the chords 14 from falling off at the back of the fireplace. The lower parts of the plate 17 and beams 11 block off any rearward or sideward flow of the air which rises through the floor opening 9.

At the forward ends 20 of the beams 11, they are joined by a vertical forward plate 21 whose extent is substantially similar to that of the rear plate 17, likewise welded so that its lower edges are in the same plane as the lower extremities of the lower beam chords 13. Like the rear plate 17, it extends upwardly substantially above the level of the upper beam chords 14, its upward extending portion 22 prevents logs from rolling forward off the andiron surfaces of the upper chords 14. Extending about two-thirds of the width between the beams 11, the forward vertical plate 21 has a draft opening cut-out 23, which may be rectangular as shown, and may extend upward to the horizontal plate, to be referred to.

Immediately above the level of the draft opening cut-out 23, at substantially the midheight of the beams 11, the portions of the web 12 facing each other are sealedly joined by welding a horizontal tunnel plate 30, which extends the entire length from the rear vertical plate 17 and the forward vertical plate 21. Accordingly, draft air entering from the outside and rising through the ash chamber 10 and opening 9 must flow forward beneath the horizontal tunnel plate 30, out the forward draft opening 23, thence up over the upward extending portion 22 of the forward plate and back over and beneath the logs resting on the surfaces, shown schematically in FIG. 2, to the flue 7. Such logs 32 are illustrated schematically in FIG. 2. Hot coals and ashes 33 may drop upon and be temporarily stored on the tunnel top plate 30 without blocking the flow of the combustion air beneath, as well as over and around, the logs 32, so that newly added logs are quickly kindled. The forward plate upward extending portion 22 so baffles the draft from the opening 23 as to avoid concentrating it on the foremost log. Instead it baffles the airflow laterally as well as upwardly, to promote fairly even combustion.

In order to control the draft, I believe it most simple and convenient to provide for transverse movement of the damper. Such transverse movement is provided by suspending a damper plate 34, whose size at least equals that of the draft opening 23, by a horizontal rod 35 whose center part is welded to the plate forward surface slightly above mid-height of the damper plate 34, the rod 35 being somewhat over three times as long as the plate 34 is wide. The projecting ends of the rod 35 pass slidably through horizontally aligned steel eyes 36, 37 welded to project forwardly from the forward plate 21 as shown in FIG. 2. That end of the rod 35 toward which the damper plate moves when opened may be bent up to serve as a handle portion 38, as shown. Such a sliding damper may be handled readily to pull the damper plate to the right, as shown, to permit the desired degree of opening and hence control the draft.

With the draft so controlled, substantially all flow of air from the room into the fireplace and out of its flue, is cut off by closing the firedoors 8. Glass firedoors permit much of the radiant heat to pass, but prevent the heated air to be drawn from the room to serve as combustion air. By supplying draft air from the outside, and leaving the warmed room air in place, the efficiency of heating is greatly improved.

The combined air tunnel and andiron device is particularly effective for fireplaces which are provided, along the sides of the hearth and flue, with metal duct heat exchangers which permit room air to circulate alongside these areas and then back out to the room. The utilization of such ventilated fireplaces, some of them equipped with electric fans, is well known.

Figure 3:
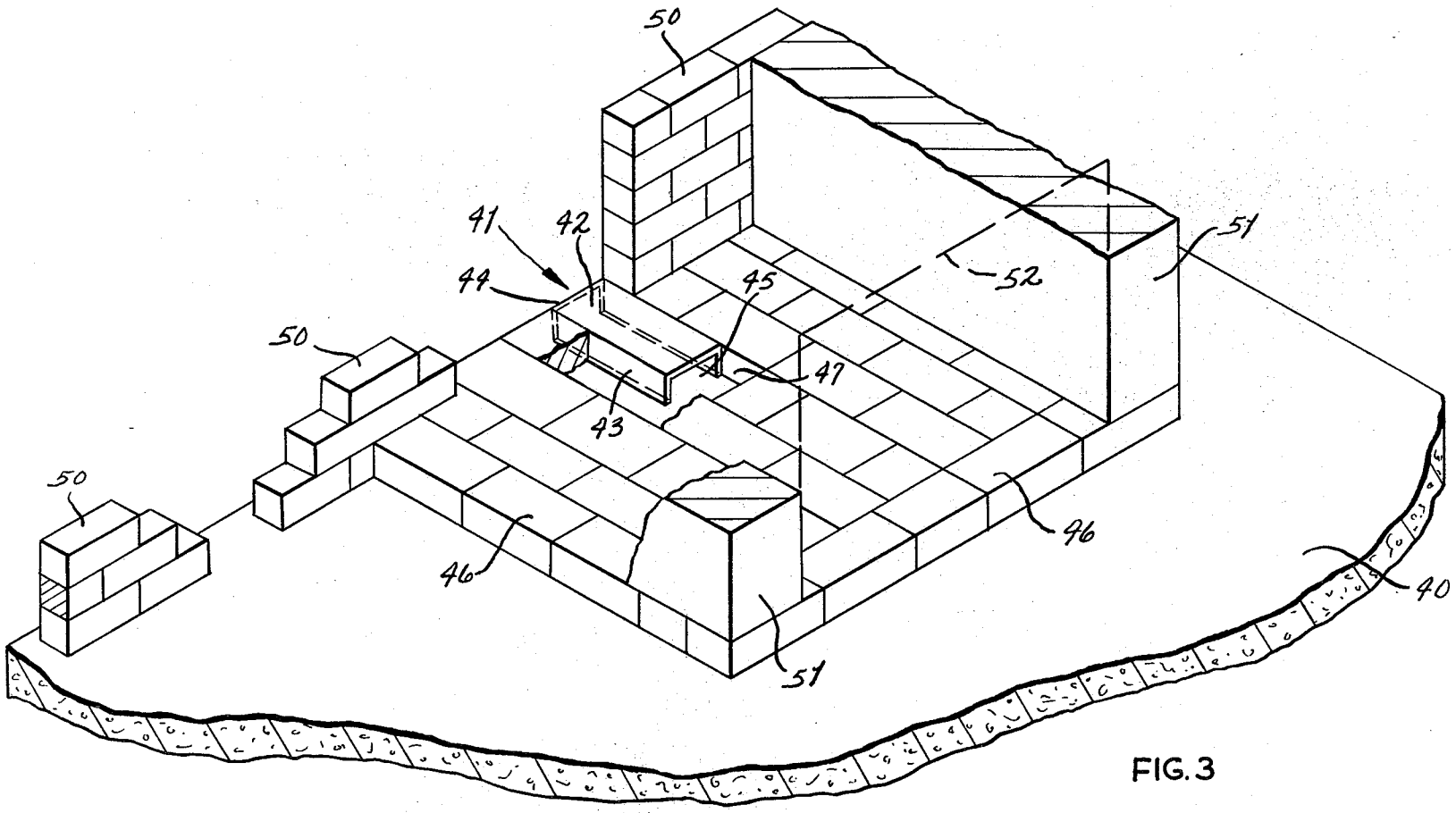
FIG. 3 is a perspective view, partly schematic, illustrating the method of constructing a residential fireplace having an external draft source, for installation of the andiron device of FIG. 1, alternative to the installation shown in FIG. 2.

For new residential construction, or for alteration where no ash clean out is provided in the fireplace floor, a new method of constructing residential fireplaces for use with the present air tunnel-andiron device is shown in FIG. 3. Utilizing a concrete slab 40 or other foundation portion having a planar upper surface, construction procedure is as follows:

After laying the slab 40, there is positioned on the foundation upper surface a fire resistant channel 41, typically a heavy structural iron channel, inverted as illustrated. This presents its planar outer web surface 42 upwardly. The length of the channel 41 is substantially greater than the thickness of the outside wall; when so positioned on the planar slab surface 40, it provides an air duct extending from an outer end 44 at the outer wall of the building to an inner end 45 spaced somewhat forward of the inner surface of the building wall 50 to be built. Thereafter, the building wall 50 is constructed on the slab 40 in conventional fashion, leaving the channel outer end 44 open, for subsequent screening to prevent the entry of rodents and the like.

Thereafter, a smooth fireplace floor is laid preferably of fire-resistant brick 46 whose thickness equals substantially the depth of the inverted channel 41, so that its upwardly presented web surface 42 is flush with the floor so provided. The air tunnel-andiron device of FIG. 1 may now be put in place, with its rear vertical plate 17 resting substantially sealedly upon and across the web surface 42 and on the brick surface 46 adjacent on both sides, and with its lower andiron chords resting substantially sealedly on the floor surface 46.

As shown in FIG. 3, the brick floor 46 is contiguous with the side walls 43 of the channel 41. However, no brick is laid adjacent to the channel inner end 45; instead a gap 47 in the flooring is there provided. The fireplace construction then is continued in the conventional manner to provide fireplace side walls 51 in which a ventilated heat exchange system may be installed in the conventional manner, as well as a fireplace opening 52 to be screened by conventional glass firedoors.

In use, fireplaces so constructed draw air through the duct passage defined by the inverted channel 41 and the upper surface of the foundation slab portion 40, and thence up through the gap 47 at and forwardly of the inner end 45 of the channel, to the underside of the tunnel plate 30, for combustion in the same manner as illustrated in the FIG. 2 embodiment.

I claim:

1. For use on a fireplace floor having a rearward-positioned upward draft opening, a combination air tunnel and andiron device fabricated of fire-resistant metal and comprising a pair of spaced-apart fore-and-aft extending parallel beams, each having a substantially vertical web portion and upper and lower beam chord portions, a substantially horizontal tunnel plate joining those beam web portions facing each other at a height intermediate their upper and lower chord portions, whereby to provide an air tunnel extending from the lower beam chord portions upward to the tunnel plate, and to provide andiron portions extending upward from the tunnel plate to the upper beam chord portions, a substantially vertical aft plate extending across the rear ends of said beams and joining same and the aft edge at tunnel plate, whereby its lower edge and the lower edges of said lower beam chord portions lie in a plane and when rested on such fireplace floor block off the rear of said air tunnel, said rear plate having an upward extending portion above said upper beam chord portions, whereby to provide rear restraint for firewood resting on the said upper chord portions, and a substantially forward vertical plate extending across the forward ends of said beams and joining same and the forward edge of said tunnel plate and having a draft outlet below said tunnel plate, the said forward plate having an upward extending portion above said upper beam chord portion, whereby to provide similar forward restraint for logs on said upper beam chord portions, there being an open space between the said beams above said tunnel plate, whereby to accommodate ashes and provide draft beneath such logs and cooling of said tunnel plate, in combination with adjustable means to provide varied closure of said draft opening.

2. A combination air tunnel and andiron device as defined in claim 1, in which said adjustable closure means comprises a plate large enough to substantially cover the said draft opening, and means to position said plate adjustably and slidably along the forward surface of said forward plate.

3. The combination air tunnel and andiron device as defined in claim 1, in combination with a fireplace having a foundation surface, fireplace aft and side walls, a rearward chimney opening, a forward fireplace opening, and a fireplace floor comprised of fire-resistant brick laid on said foundation surface, and means to introduce outside air comprising an inverted channel formed of fire-resistant metal having a screened rear end and a forward open end, said channel being of a depth substantially equal to that of the thickness of the fire-resistant brick and having downward positioned chord surfaces supported on said foundation surface and an upwardly presented channel web surface at the level of and forming part of said fireplace floor, there being a gap in said fireplace floor above said foundation surface and forward of the forward end of said inverted channel, whereby when said combined air tunnel and andiron device is positioned on the fireplace floor over said gap with its aft plate aft of said gap, draft air may enter through said inverted channel and floor gap for flow upward and forward beneath the horizontal tunnel plate and out through the draft outlet.

* * * * *